United States Patent [19]

Schippers et al.

[11] 3,930,292

[45] Jan. 6, 1976

[54] DEVICES FOR THREADING FILAMENTS ON ROLLERS

[75] Inventors: Heinz Schippers; Erich Lenk, both of Remscheid, Germany

[73] Assignee: Barmag Barmer Maschinenfabrik Aktiengesellschaft, Wuppertal, Germany

[22] Filed: Feb. 3, 1975

[21] Appl. No.: 546,600

[30] Foreign Application Priority Data

Feb. 8, 1974 Germany ..... 2405990
July 6, 1974 Germany ..... 2432435

[52] U.S. Cl. ..... 28/71.3
[51] Int. Cl.[2] ..... D02J 1/22
[58] Field of Search ..... 28/71.3, 71.4, 59.5; 425/66; 264/291, 292, 288, 290 R

[56] References Cited

UNITED STATES PATENTS 3,172,187 3/1965 Ivanto ..... 28/71.3
3,323,191 6/1967 Davies ..... 28/71.3 X

*Primary Examiner*—Louis K. Rimrodt
*Attorney, Agent, or Firm*—Johnston, Keil, Thompson & Shurtleff

[57] ABSTRACT

Filament processing apparatus embodying the combination of one or more rotatable rollers for conveying a filament or a plurality of filaments axially spaced on said roller(s) and looped at least partially about the respective roller surfaces, and a tubular roller-threading device which is a longitudinally slotted tube having at least a curvate portion adjacent the respective roller(s). The filament, preferably either knotted at its feed end or attached to a plug at its feed end, is drawn through the tubular roller-threading device by a fluid stream applied at a single or axially spaced points into the tube. The longitudinal slot of the tube allows the fluid-conveyed filament to be drawn out of the tube when the filament is placed in tension, e.g., after it has been fed around the respective rollers, and processing thereof is ready to begin.

20 Claims, 22 Drawing Figures

FIG. 6
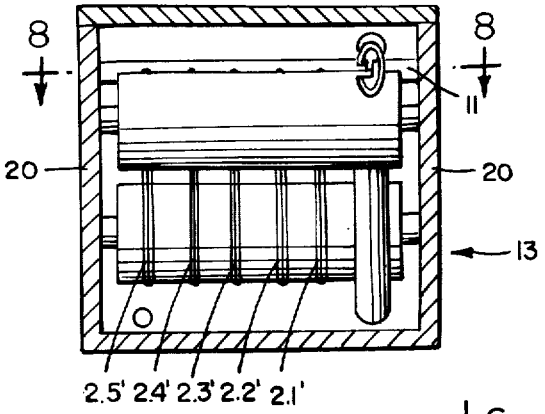
FIG. 7
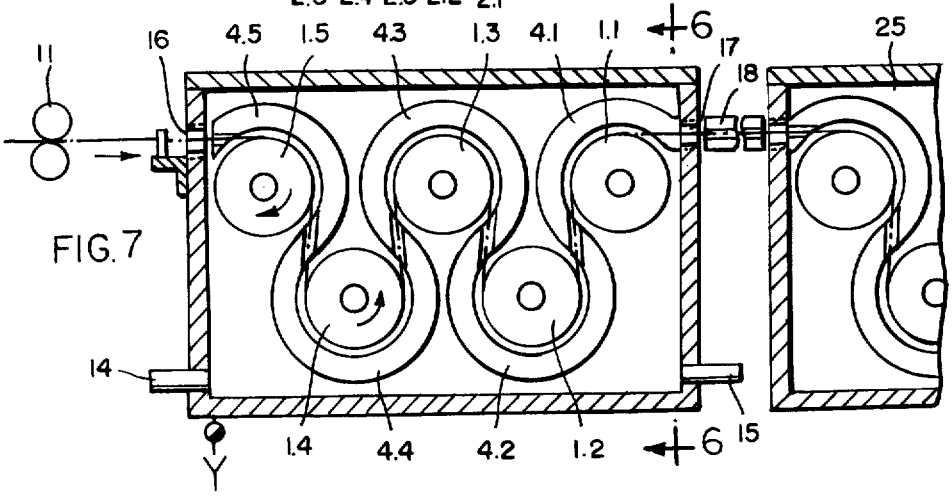
FIG. 8
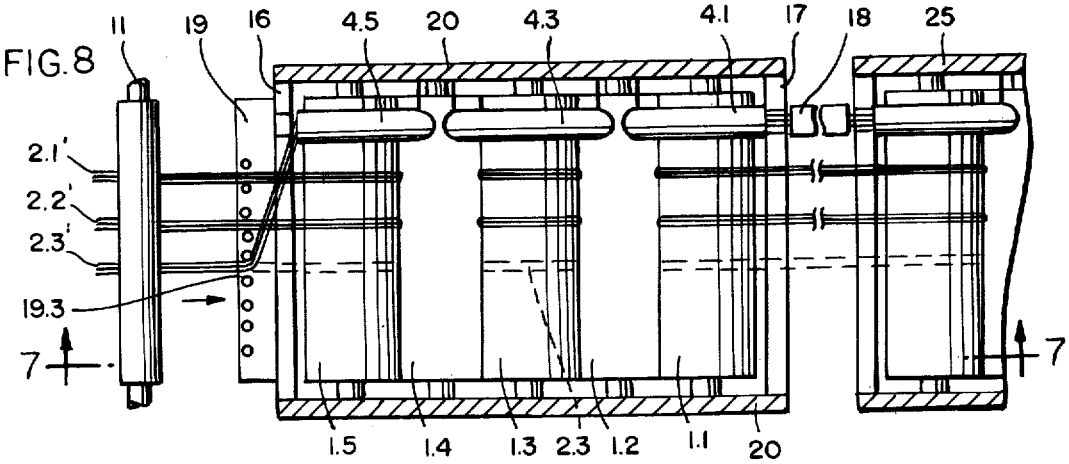
FIG. 9a
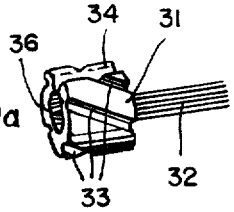
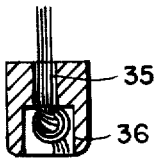
FIG. 9b FIG. 10a
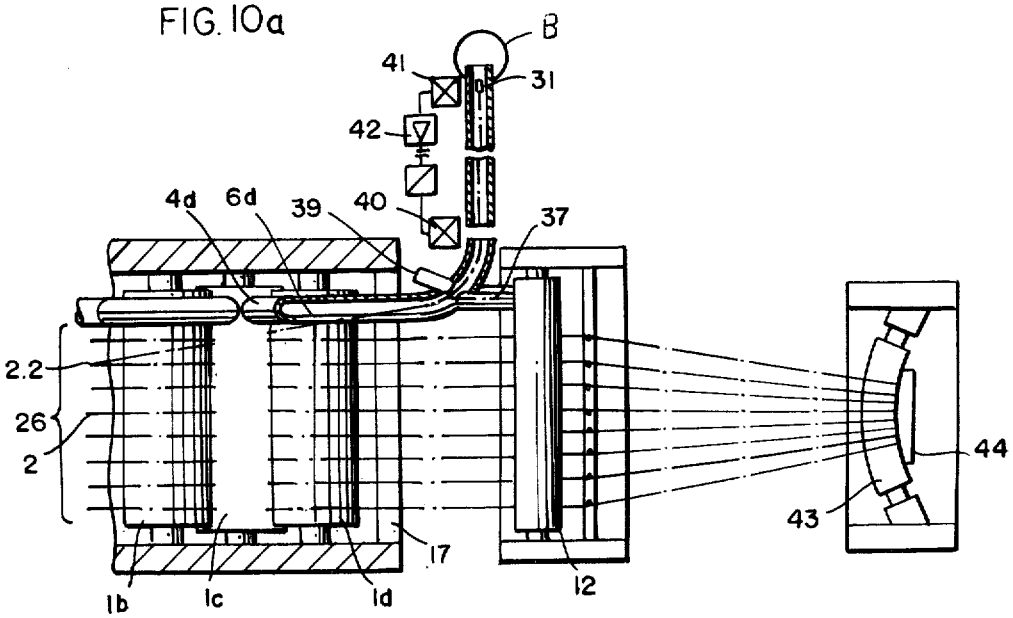
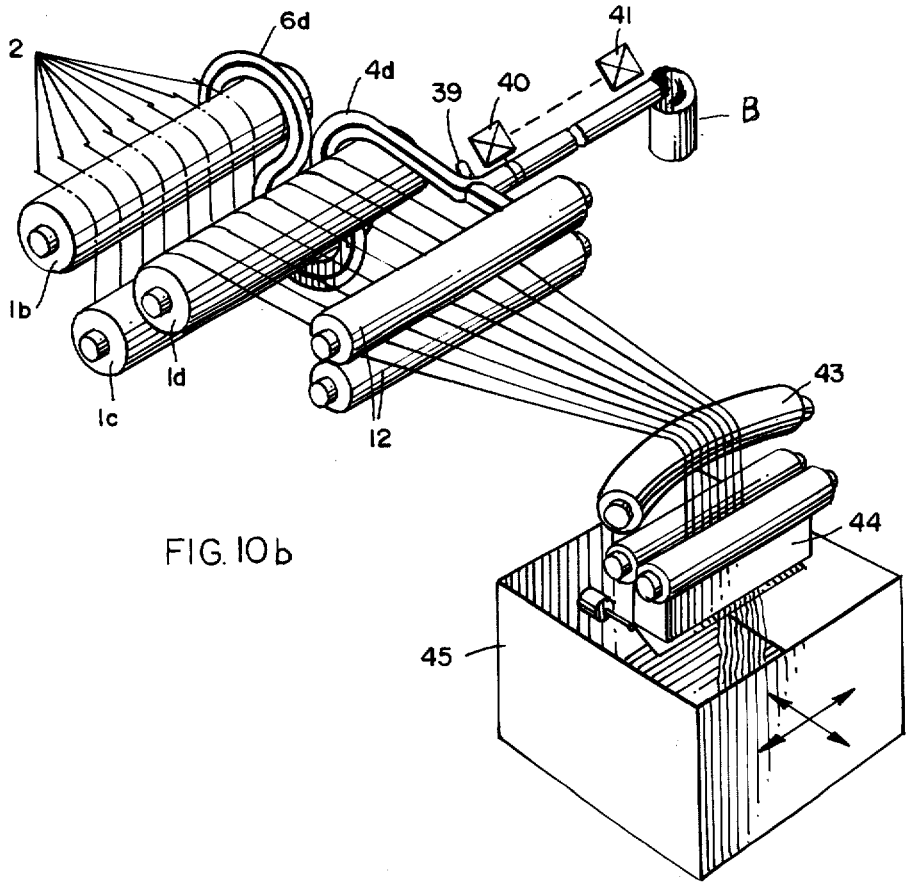
FIG. 10b

DEVICES FOR THREADING FILAMENTS ON ROLLERS

The application of filaments traveling at high speed, more especially synthetic filaments which may be traveling at speeds of more than 1000 metres per minute, requires a high degree of skill. The application of filaments of high denier, for example several thousand denier, to the rollers of stretching arrangements is extremely dangerous because tensile forces can be applied by filaments of this kind. Wherever possible, filaments should be threaded at low speed, which necessitates special machinery, may lead to overlong residence times where several filaments are processed on a single roller and is time consuming. The need to thread a traveling filament onto a roller or a filament onto a rotating roller by hand necessitates a special machine construction to enable the filaments to be looped around the roller from one end thereof. Accordingly, the rollers either have to be mounted at one end or the machine frame has to be arranged in such a way that the means by which the filaments are threaded can travel around the entire looping angle.

The one-ended cantilever-style mounting is extremely prone to wear and has to be made very strong for several filaments to be continuously stretched parallel to one another over the same rollers. The two-ended mounting of rollers gives rise to an extremely complicated structure of the machine frame on the servicing side in cases where several rollers are arranged in succession, for example in ribbon stretching arrangements in the form of duos, trios, etc. The reason for this complicated structure is that the machine frame has to consist of an upper cross member and a lower cross member to which vertical supports are fixed in order to accommodate the roller mounting. The supports for those rollers which the filaments approach in an upward direction and leave in a downward direction are fixed to the upper cross member, whilst the supports for those rollers which the filaments approach in a downward direction and leave in an upward direction are fixed to the lower cross member (cf. German Pat. No. 916,974).

The object of the invention defined in the claims is both to simplify and to improve the design of the rollers for transporting filaments and, more especially, multiple-roller arrangements by automating the threading of filaments and suitably designing the threading aid.

In the context of the invention, a roller is any rotatable body, either freely rotatable or driven, around which one or more filaments is/are looped, for example godets, delivery cylinders with clamping rollers or belts for applying the filament, rolls, wheels, rotatable pins, guide rolls, etc.

Rollers of this kind may be used, for example, as transporting rollers for filaments, as heating rollers, as delivery and stretching rollers in the stretching of synthetic filaments. They may also be present in the form of multple-roller arrangements. In the context of the invention, multiple-roller arrangements are arrangements of identical or different (different diameters, different temperatures, different drive speeds, freely rotatable and driven) rollers around which the filament is looped either in one or more common loops (for example the godet with its associated guide roll according to German Utility Model No. 1,967,322) or around which the filament is partly looped alternately to the left and to the right (duo, trio, etc., for example the looptype stretching arrangement according to German Published Application No. 2,328,639). Filaments in the context of the invention are natural fibres and monofilament or multifilament man-made fibres and in particular, ribbons of film (for example, German Published Application No. 2,328,639), ribbons of fibrillated film (for example according to German Published Application No. 1,660,230), tows of synthetic fibres for the production of staple fibres, multi-filament synthetic fibres for further processing in spinning, stretching, crimping machines, etc.

The longitudinal slot may extend along any generatrix of the tube. It is best situated as substantially opposed to or facing the surface of the roller or, in more particular embodiments, opposite or facing the working zone for the filament(s) on the roller. Here, the longitudinal slot faces outwardly in a direction substantially parallel to the working surface of the roller. In cases where several filaments are present on one roller, a greater angular range is available for the most suitable arrangement of the longitudinal slot. In cases where several filaments traveling parallel to one another are each processed in their own working zone on one roller on which the threading arrangement is used, each working zone is preceded by its own filament guide. For threading, each filament is first guided by the filament guide associated with its working zone. When the filament is then introduced into the threading aid, it would be in danger of not sliding out of the longitudinal slot if the longitudinal slot were too far away from the working zone. This disadvantage is obviated by the solution wherein the longitudinal slot has a funnel-like widening at the inlet end of the tube, the edges of the longitudinal slot beginning on the generatrices which each face towards the outermost working zone of a filament on the roller.

In the case of multifilament man-made fibres with high overall deniers, and especially in the case of tows of the type used for the production of staple fibres, it has been found that it is not only the holding together of the beginning of the filament by a plug which provides the threading aid with favorable delivery properties, but also it is of advantage to hold the entire tow together in such a way that no individual filaments unintentionally jump out of the longitudinal slots or become entangled with filaments that have already been threaded or form the beginning of a wrap and, hence, lead to failure of the threading operation. Individual filaments are largely forced out of the longitudinal slot by air turbulence in the tube which occurs in particular at those points where the tube is interrupted, where the tube has lateral slots or where air inlet openings open into the tube.

One particular object of the invention is also to enable several filaments traveling parallel to one another to be automatically threaded onto a roller or multiple-roller arrangement by only a single threading means according to the invention. Another object of the invention is to design the machine frame of the multiple-roller arrangement in such a way that even fairly considerable tensile forces can be applied by the rollers in spite of an inexpensive, lightweight and compact construction, and also in such a way that the machine frame is compact and largely uninterrupted. In another arrangement according to claim 8, the filament is prevented from leaving the longitudinal slot during threading before it has been caught by the delivery unit following the roller.

The longitudinal slot can differ in width according to the denier of the filament to be threaded. However, in cases where the longitudinal slot is both wide and long, there should be no need for excessive air consumption. Another object is to obtain safe delivery of the filament through the threading aid with minimal air consumption where the invention is used.

Another object of the invention is to ensure that the tow does not break up into its individual during threading.

Another object of the invention is to enable several filaments traveling parallel to one another to be automatically threaded onto a roller or a multiple-roller arrangement by only a single threading aid according to the invention.

Yet another object of the invention is to design the machine frame of the multiple-roller arrangement in such a way that even fairly considerable tensile forces can be applied by the rollers in spite of an inexpensive, lightweight and compact construction, and also in such a way that a compact, largely uninterrupted machiine frame is obtained.

Another problem is to release the individual tows from the threading aid at the end of a looping-type stretching arrangement and to remove both the plug and the first unstretched part of the tow.

Exemplary embodiments of the invention are described in the following with reference to the accompanying drawings, wherein:

FIG. 1*a* is a front elevation of a roller with a threading aid.

FIG. 1*b* is a side elevation of a roller with a threading aid.

FIGS. 2*a* to 2*c* show front, top and side views of a threading aid with a lateral longitudinal slot on one roller with several working zones.

FIGS. 3 to 5 show different embodiments of multiple-roller arrangements with respective threading aids and respective types of longitudinal slots.

FIGS. 6 to 8 are sections through looping-type stretching arrangements in series, the sections being taken on section planes 6—6, 7—7, and 8—8 of these Figures. FIGS. 9*a* and 9*b* are a perspective view of and a diametric section through, respectively, a plug to which the beginning of the filament(s) is fastened.

FIGS. 10*a* and 10*b* show an embodiment of a multiple-roller arrangement in partially sectioned top plan view and in a partial perspective view of the filament-handling parts, including the threading aid and rollers, which roller arrangement is used at the end of a filament processing operation.

FIGS. 11*a* to 11*b* are side and top views, the latter partly sectioned, of a multiple-roller arrangement and associated roller-threading aid, useful at the beginning of a filament-processing operation.

Figure 1A:
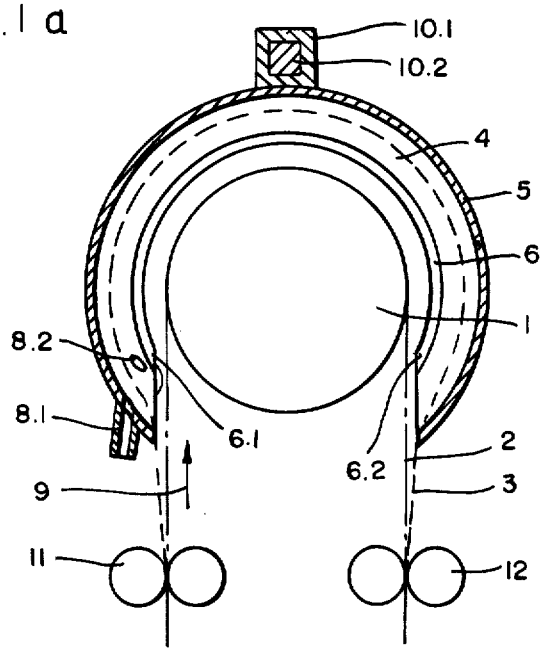
Figure 1B:
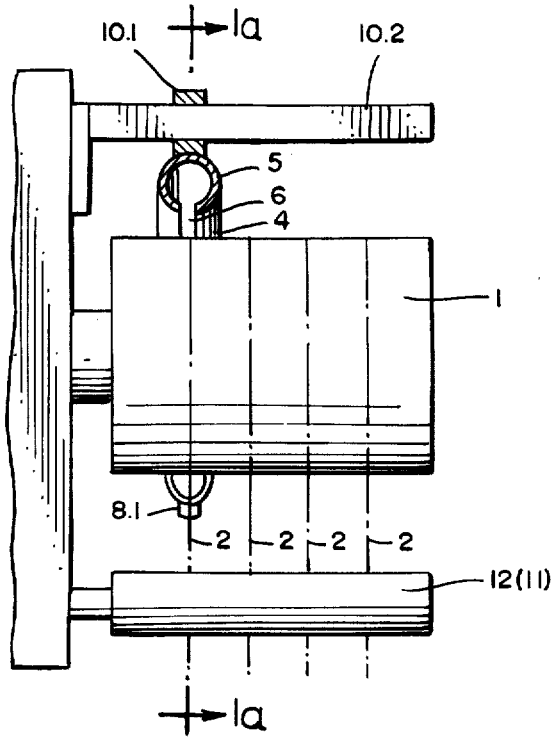

Referring to the drawings, FIG. 1*a* shows a roller 1 around which the filament 2 is looped through 180°. The tube 4 surrounds the roller 1. The tube 4 is mounted for axial displacement through a guide 10.1 on a bar 10.2. The roller 1 is driven and, in this way, transports the filament in the direction of the arrow 9. In FIG. 1*a*, the tube is shown in section on the section plane 1*a* —1*a* of FIG. 1*b*. It can be seen from FIGS. 1*a* and 1*b* that the wall 5 of the tube is formed with a longitudinal slot 6. This longitudinal slot 6 extends substantially from the intersection 6.1 of the filament traveling onto the roller 1 to the intersection 6.2 of the filament leaving the roller 1 with the tube wall, i.e. in the present case over the length of the innermost side of the tube. The tube has an air stream flowing through it for entraining the plug plus filament from the beginning to the end of the tube and for transporting it at such a high speed that it is unable to jump out of the longitudinal slot 6 on account, inter alia, of its centrifugal force. When the filament delivered by the diagrammatically illustrated delivery rolls 11 is taken up by the delivery rolls 12, again diagrammatically illustrated, it is pulled through the longitudinal slot 6, applied to the roller 1 and transported by that roller. The air stream can be produced by any known means. FIG. 1 shows injectors 8.1 and 8.2 which produce an air stream with a high rate of flow in the tube 4. The injectors are switched on when the filament is threaded and subsequently switched off again. Several filaments may be threaded onto the roller 1 by axially displacing the tube 4 along the bar 10.2.

Figure 2A:
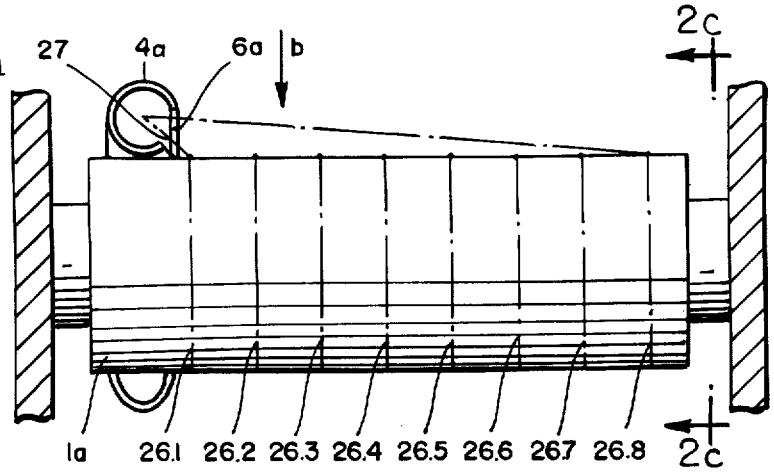
Figure 2B:
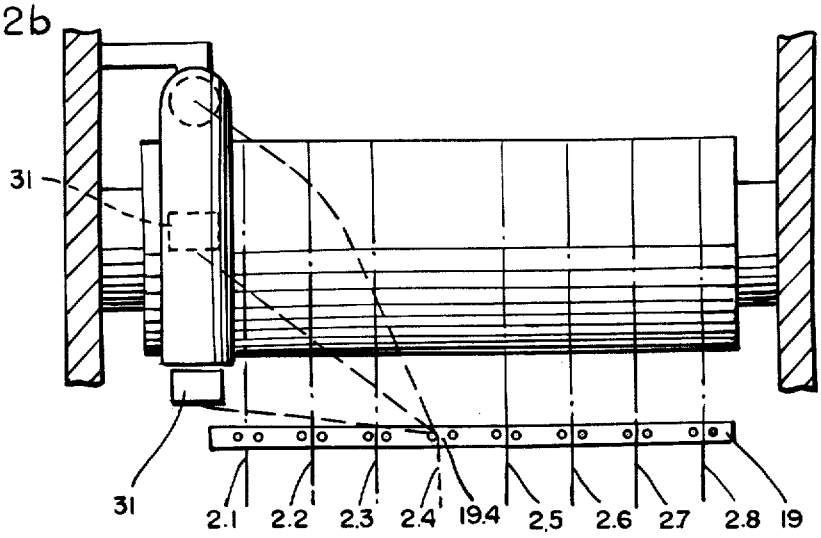
Figure 2C:
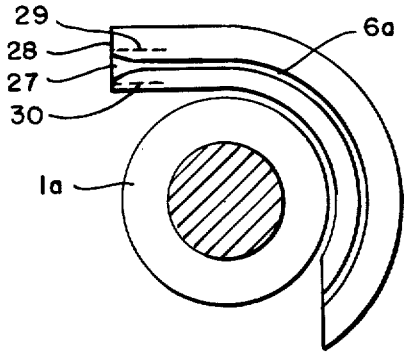

FIGS. 2*a* to 2*c* show the roller 1*a* on which several filaments are processed. The tube 4*a* serving as threading aid comprises a longitudinal slot 6*a* which faces towards the working zones 26.1 to 26.8 where a corresponding number of filaments 2.1 to 2.8 are looped around the roller 1. At its beginning, the longitudinal slot has a funnel-like widening 27 beginning on the tube circumference 28 along the generatrices 29,30 which face towards the outermost working zones 26.1 on the one hand and 26.8 on the other hand. It can be seen from FIG. 2*b* that the filament 2.4 has just been threaded. The various phases involved in the threading operation are shown. The beginning of the filament is fastened to the plug 31 (FIGS. 9*a* and 9*b*). By virtue of the funnel-like widening of the longitudinal slot 6*a* on the tube circumference 30, the plug 31 can be introduced into the tube, while the filament 2.4 is immediately pulled out of the longitudinal slot towards the comb 19 and the place 19.4 reserved for it on that comb. The filament then slides along one edge of the longitudinal slot, while the filament plug 31 is carried along by the air stream flowing through the tube.

Figure 3:
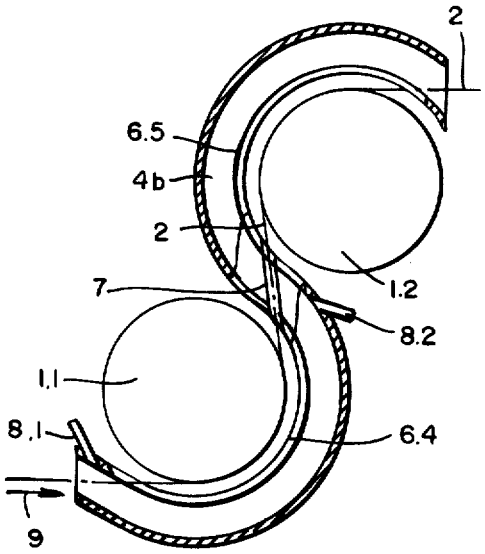

By way of explanation of FIG. 3, it is pointed out that the tube 4*b* is shown in elevation in the vicinity of the transverse slot 7, but in longitudinal section elsewhere. FIG. 3 shows an arrangement of two rollers 1.1 and 1.2 around which the filament 2 is partly looped. The tube 4*b* surrounds the rollers 1.1, 1.2 in the same direction as the filament 2. The longitudinal slots 6.4, 6.5 are each situated on the inside of the curve. They again begin and end at the points where the filament intersects the tube wall. The slots 6.1 and 6.2 situated in a distance of 180° from one another around the circumference of the tube communicate with one another through the transverse slot 7. This transverse slot is situated on the tangential plane to the two rollers 1.1 and 1.2 in which the filament path 2 is also situated.

The lateral slot 7 enables the filament to be displaced in the axial direction, i.e. in the direction of the observer in FIG. 3, on the rollers 1.1 and 1.2 after threading.

As already described in reference to FIGS. 1 and 2, the tube 4*b* shown in FIG. 3 is provided with the necessary injectors for producing the necessary flow of air in the tube. In the interests of completeness, it is pointed out that the air flow can also be produced by filament suction units arranged at the end of the tube. A certain suction effect can also be produced by injectors arranged at the end of the tube which, as shown in FIG. 4, are arranged at the end of the tube directed towards the center thereof and inclined in the direction of filament travel, i.e. injectors 8.5, to aid upstream injectors 8.1 and 8.2.

Figure 4:
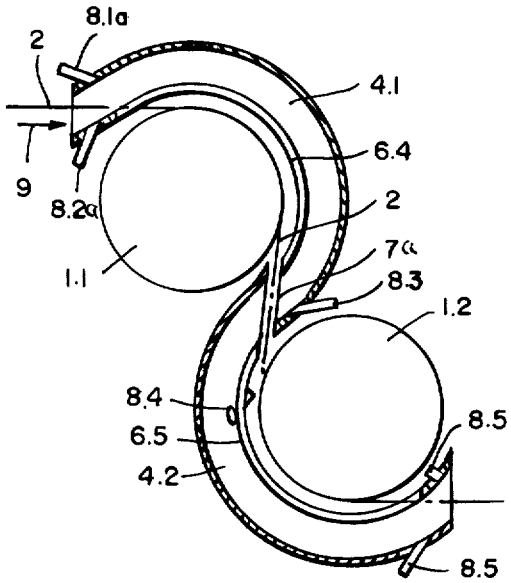

FIG. 4 shows a modification of the embodiment illustrated in FIG. 3. For threading and laterally displacing the filament 2 traveling in the direction of the arrow 9, the lateral slot 6 is formed by arranging two tube sections 4.1 and 4.2 very close to one another. To promote flow, the outlet end of the tube section 4.1 is designed in such a way and directed towards the funnel-like inlet opening of the tube section 4.2 in such a way that the filament is safely transferred from the tube section 4.1 to the tube section 4.2. The injector 8.3 is also used for safely transferring the filament from one tube section 4.1 to the other tube section 4.2. Upstream injectors 8.1*a*, 8.2*a* of tube section 4.1 and downstream suction-effect injectors 8.4 and 8.5 of tube section 4.2 are also used and have functions which are previously described. The joint 7*a* between the two tube sections 4.1 and 4.2 is situated in the tangential plane to the rollers 1.1 and 1.2 which coincides with the path 2 followed by the filament.

Figure 5:
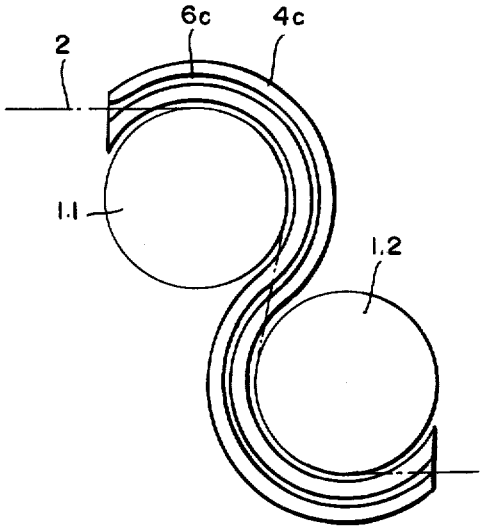

FIG. 5 shows a multiple-roller arrangement in which the threading aid has a laterally-facing longitudinal slot 6*c*.

FIGS. 6 to 8 illustrate one application for which the invention may be used with particular advantage. FIGS. 6 to 8 show a stretching arrangement for tows. Synthetic tows 2.1′ to 2.5′ are stretched on the rollers 1.1 to 1.5. As shown in FIGS. 6 and 8, the rollers are mounted at both ends in the machine frame 13. The looping-type stretching arrangement shown in different elevations and sections in FIGS. 6 to 8 is heated with steam through the openings 14,15. Five tows each with a denier of more than 100,000 denier are stretched. Considerable stretching forces have to be applied by the rollers 1.1 to 1.5.

In practice groups of tows of for example 100 and more individual tows are processed in this way.

Since the rollers 1.1 to 1.5 of the quintet are mounted at both ends in the substantially uninterrupted side walls of the machine frame 13, the roller mountings and the rollers themselves may be made relatively small in diameter and considerably smaller in diameter than in the case of one-ended mounting. This favorable construction may be obtained by using a threading arrangement consisting of a tube 4 which is made up of individual tube sections and which corresponds in its structure to the threading arrangement illustrated in FIG. 3 or FIG. 4. Another advantage of this threading arrangement is that the looping-type stretching unit is accommodated in a machine frame closed on all sides, so that heat losses can be largely avoided. The looping-type stretching unit merely comprises the inlet slot 16 and the outlet slot 17 which extend substantially over the entire working width of the stretching unit. The inlet slot is preceded by a guide comb 19 through which the individual tows 2.1′ to 2.5′ are guided on their predetermined paths. It can be seen from FIG. 8 that the tows 2.1′ and 2.2′ are already being processed in the stretching unit on the paths provided for them. The tow 2.3′ has to be rethreaded. For this reason, the tow is first guided to its place 19.3 on the inlet comb 19 and then into the inlet of the tube section 4.5. The tow is guided through under the already traveling tows 2.1′ and 2.2′. The injector system of the multiple-section tube system 4.1 to 4.5 is then switched on and the two 2.3′ carried through the tube until it leaves the tube section 4.1 where it is picked up by another tube 18 and guided through that tube to the next looping-type stretching unit 25 (which is only shown in part). When the tow 2,3′ is picked up by the tube 18, it is pulled out of the axially directed transverse slots of the tube system 4.1 to 4.5 and applied to the rollers 1.1 to 1.5. When the tow has been threaded onto the next looping-type stretching unit 25 as well and run off by its rollers, it moves through axially under the already threaded tows 2.1′ to 2.2′ until, finally, it reaches its place 2.3′.

The application of the invention to the looping-type stretching arrangement in the exemplary embodiment illustrated provides for a construction which is favorable not only mechanically, but also in regard to heat technology, and enables machines to be serviced reliably in contrast to conventional looping-type stretching arrangements.

FIG. 9*a* is an perspective view of a plug 31, e.g. a cylinder, which is attached to the beginning 32 of the filament(s). The plug has in its cylindrical surface grooves 33 which are inclined in the same direction relative to the plug's longitudinal axis and towards the generatrices. The effect of these grooves is that the plug rotates under the effect of the air stream flowing through the guide tube and, in doing so, imparts a certain number of twists or turns to the filament(s) or tow to which the plug is fastened. A relatively small number of twists, for example 10 per meter, is sufficient to guarantee that the tow entrains its individual filaments so that the individual filaments can no longer become separated from the tow.

The plug further comprises a longitudinal slot 34 through which the filament or tow can readily be introduced into the axial bore 35 (cf.,FIG. 9*b*). The bore 35 has a forward or front counterbore or wider hole 36. The knot tied at the beginning of the filament or tow is able to lie wholly within this hole 36 so that the movement of the plug is not prevented by projections of the inevitable loose fiber ends.

FIGS. 10*a* and 10*b* show the end of a multiple-roller arrangement, for example a looping-type stretching arrangement with the rollers 1*b*, 1*c* and 1*d* and the tube system 4*d*. The longitudinal slot 6*d* faces towards the working zones 26 of the filaments 2 on the rollers 1. The tube system 4*d* is curved in the vicinity of the outlet slot 17 in such a way that the plug 31 is able to travel through the curve without impediment. The outlet 37, in the form of a tube socket, it also situated in the curve. The longitudinal slot 6*d* of the tube system 4*d* extends up to this outlet 37. The orifice of the injector nozzle 39 is directed towards the outlet 37. The outlet 37 is arranged in the tube in such a way that the plug 31 is unable to enter the outlet 37 or to interfere with the travel of the plug through the tube 4*d*. Behind the injector nozzle 39 there is a filament cutter 40 whose cutting blade is arranged in such a way that it is able to cut the tow traveling through the tube. The cutter is followed by a detector 41 which is designed to generate an output signal when the plug 31 passes the detector. The detector may be based on magnetic, electronic, pneumatic or optical detection principles.

The output signal from the detector 41 is relayed through amplifiers 42 and other suitable instruments to the filament cutter 40 in order to actuate the cutter 40. The distance between the detecter 41 and the cutter 40 is such that the length of filament or tow between those components corresponds to the length of filament or tow in the looping-type stretching arrangement. This ensures that, when a tow is threaded, the unstretched part of that tow, which represents waste, can be cut off and collected in a waste colleetor, so that only useful material is used for processing. The illustrated waste collector is the cloth bag B.

Cutting of the tow by the cutter 40 switches on the injector nozzle 39. In this way, the newly formed beginning of the tow is blown into the outlet 37. In the case illustrated, it is the tow 2.2 which is being threaded. The outlet 37 opens before the take-off rollers 12, so that the beginning of the tow is picked up by these take-off rollers. The tow is then delivered over the curved roller 43 to the crimper 44.

The function of the curved roller 43 is to condense the tows delivered to it in the form of a relatively wide sheet into a tight bundle of tows of substantially rectangular cross-section. Behind the curved roller this bundle is delivered to the rollers of the crimper 44. Suitable crimper constructions are described, for example, in U.S. Pat. Nos. 3,526,937; 2,763,898 and 3,398,223. Behind the crimper 44 the crimped tows are deposited in the containers 45 which makes traversing movements in two directions indicated by the crossed arrows.

Figure 11A:
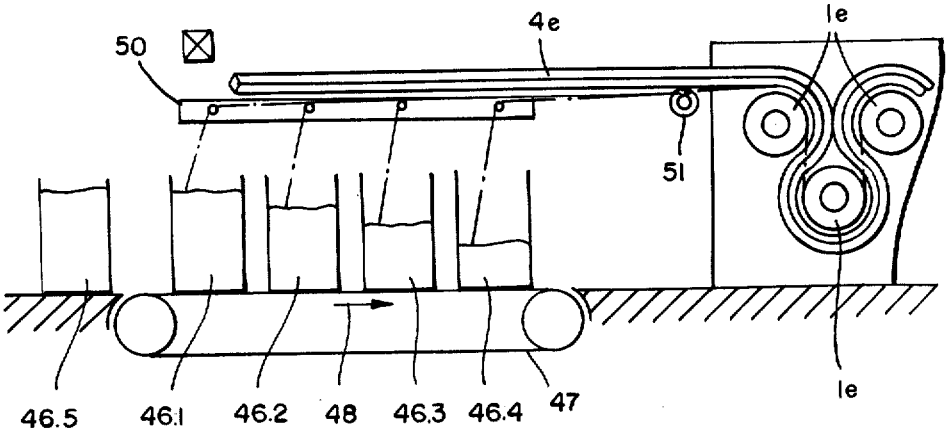
Figure 11B:
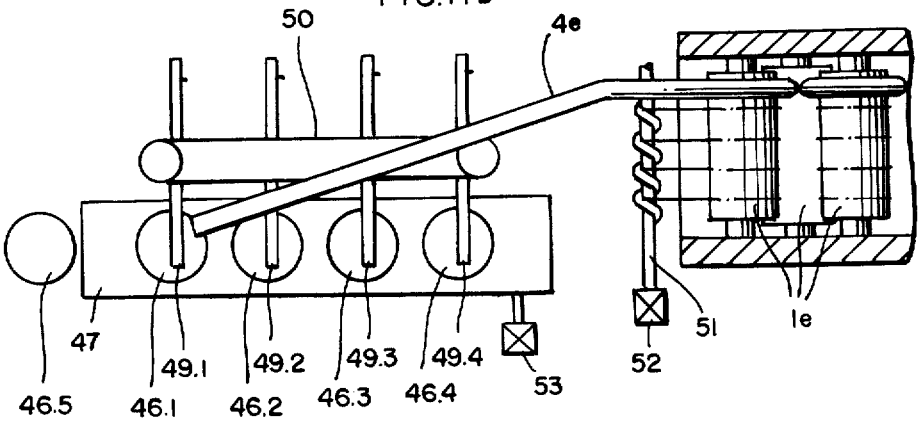

FIGS. 11*a* and 11*b* diagrammatically illustrate the loading of a multiple-roller arrangement, more especially a looping-type stretching arrangement. Several filament containers 46.1 to 46.4 travel with the conveyor belt 47 in the direction of the arrow 48. The conveyor belt 47 is intermittently driven by the motor 53. The tow from the last container 46.1 on the conveyor belt 47 is delivered by way of the guide bar 49.1 to the threading aid 4*e* after the beginning of the tow has been fastened to a plug such as plug 31. The tow is then threaded onto and processed on the multiple-roller arrangement in the same way as described above. Accordingly, the container 46.1 is emptied, as are the remaining containers. When the first container 46.4 is empty, the conveyor belt and the chain 50 with the guide bars 49.1 to 49.4 fixed thereto are advanced by a distance corresponding to the interval between two containers in the direction of the arrow 48. In this way, a new container 46.5 can be pushed onto the conveyor belt 47 in front of the container 46.1. When the conveyor belt 47 and the chain 50 move forward, the comb 51, in the form of a rotatable screw in the embodiment illustrated, is advanced by the motor 52 in such a way that the tows are axially displaced on the rollers 1*e* by distances corresponding respectively to one working zone. A new tow can then be threaded from the new container 46.5 by the threading aid 4*e*. The most important components of the container feed as herein illustrated are described, for example, in DL-PS 54,248; German Pat. No. 1,213,316 and German Pat. No. 1,143,742.

It is pointed out that the tube as a whole can also be equipped with elastic materials such as yieldable elastic strips in the vicinity of the longitudinal slot in such a way that the edges of the longitudinal slot touch one another. In this way, the flow of air in the tube is improved and air consumption reduced, while it still remains possible for the tow to be removed through the longitudinal slot by virtue of the yieldable elastic material.

Figure 12:
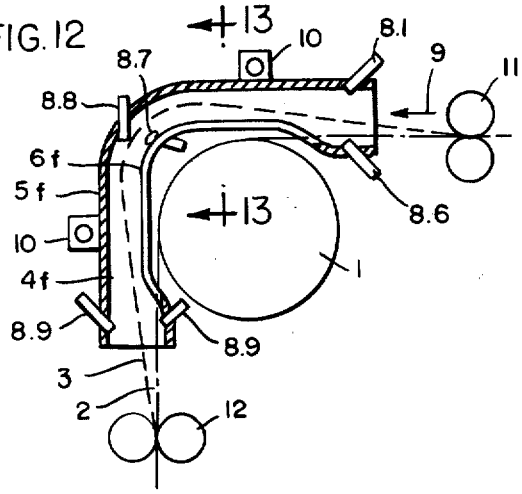
FIG. 12 is a side elevation, partly in section, of a further embodiment of a threading aid for laying filament(s) or the like upon a single roller.
Figure 13:
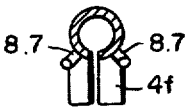
FIG. 13 is a section view, taken in section plane 13—13 of FIG. 12.

FIGS. 12 and 13 again show the roller 1 with a slightly modified threading aid in relation to FIGS. 1 and 1*a*. The tube 4 in FIG. 12 is not a circular segment, but instead has a gentle 90° curve. The longitudinal slot 6*f* extends from the intersection between tube wall and approaching filament to the intersection between departing filament and tube wall. Since the filament 2 does not have to be axially displaced on the roller 1 (only one filament is transported), the overall length of the tube is greater than the length of its longitudinal slot, which is favorable to air flow. The injectors 816, 8.7 and 8.8 are arranged on the tube. The injectors 8.6 produce an input air stream which diverts the filament into the path up to the injector 8.7. As shown in FIG. 13, the injector 8.7 has two inlet openings which are directed substantially towards the center of the tube and which are inclined in the direction of filament travel. The injectors 8.7 prevent the filament from jumping out of the longitudinal slot 6 at the bend in the tube. The injector 8.8 takes over delivery of the filament to the outlet end of the tube and to the take-off rollers 12 which again are only shown diagrammatically. When the filament is picked up by the delivery rollers 12, it is placed under tension, pulled out of the longitudinal slot 6*f* and applied to the roller 1. The injectors 8.9 at the downstream end of the tube 5*f* induce a suction effect on the filament and/or its plug as the latter feed through the tube. The members 10 are apertured brackets or bars for fixedly or slidably mounting the tube 5*f* adjacent the roller 1.

As flowing media, air or other gases but also liquids are conceivable. Liquid baths, e.g. water baths, are frequently provided. It is apparent that in such liquid baths, the tubular threading means is not filled with air but rather with the treatment liquid as the flowing medium. The invention is therefore to be understood in the sence that the curved tube conducts a stream of the fluid medium which may also be used to treat the filaments.

The tube serving as the threading means can have a circular or some other cross-section. It is not necessary that the cross-section of the plug agree with the inner cross-section of the tube, since the plug is essentially operated by the flow impulse of the flowing medium.

Figure 14:
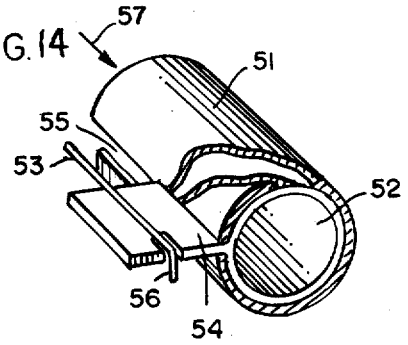
FIG. 14 is a perspective, fragmentary view, of another modification of a filament-attachment plug in a fragment of slotted threading guide tubing.

The plug 59 (see FIG. 14) can also have a sidearm 54 which projects through the longitudinal slot 55. The filament 53 in this case is fastened onto this sidearm 54 in the slot 56 thereof 56 thereof and is moved outside of the tube 51 as plug 52 is driven through the tube 51 in the direction of the arrow 57.

Figure 15:
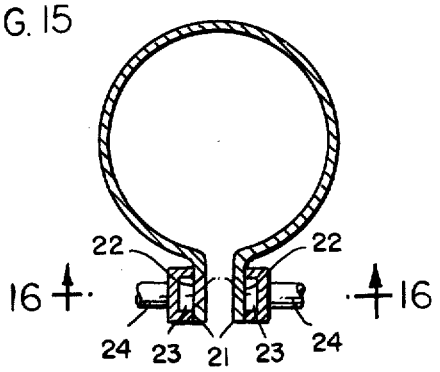
FIGS. 15 and 16 are sections of a slotted filament guide tube with another form of pneumatic supply means.
Figure 16:
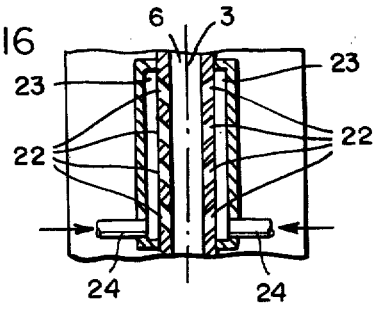

FIGS. 15 and 16 show tube cross-sections with blow nozzles for producing a curtain of air in the longitudinal slot 6. The object of this curtain of air is to prevent the filament 3 to be threaded from jumping out of the longitudinal slot. The blow nozzles 22, which are arranged on both sides of the longitudinal slot, more especially at critical points of the tube, are inclined at an angle towards the middle of the tube and in the direction of filament travel. Practical requirements will govern the particular arrangement and inclination required. The blow nozzles receive compressed air through the blow ducts 23 and the tube connections 24. The blow ducts are fitted onto and fixed to the tube wall. The side walls of the tube onto which the blow ducts 23 are fitted are denoted by the reference 21.

In the embodiment of FIGS. 3–8, 10*a*, 10*b*, 11*a* and 11*b*, the filaments or tows are looped over a series of two or more rollers. These filaments or tows are looped over successive rollers in directions which are alternately and successively clockwise and counter-clockwise, i.e., in opposite looping directions.

The invention is hereby claimed as follows:

1. In a filament processing apparatus, the combination of a rotatable roller or a series of at least two rotatable rollers for conveying a filament or filaments looped at least partially around the respective roller surfaces, and a tubular roller-threading device embodying a tube through which a filament may be conveyed by a fluid stream flowing in said tube, having at least a curvate portion adjacent said roller(s) and extending over an angle extending substantially approximate to the angle of looping of the filament(s) on the roller(s), said curvate portion lying in a plane substantially perpendicular to the axis of its continguous roller, and said curvate portion having a longitudinal slot through which a fluid-conveyed filament may be drawn out of said tube when the filament is placed in tension.

2. A combination as claimed in claim 1 wherein the end of the filament to be fed into said tube is attached to a plug member designed to be driven through said tube by the fluid stream.

3. A combination as claimed in claim 2, said plug having peripheral grooves inclined in the same direction towards the generatrices of the plug.

4. A combination as claimed in claim 2, and comprising a looping-type tow stretching apparatus, wherein the tube is curved at the end of the looping-type stretching arrangement and, in the vicinity of the curve, comprises a filament cutter which is actuated by a detector for the plug.

5. A combination as claimed in claim 4, wherein, in the vicinity of the curve, the tube has an outlet which terminates in front of a tow-entraining means, and air jet means by which the beginning of the cut tow is blown into said outlet.

6. A combination as claimed in claim 4, wherein the distance between said detector and said filament cutter is equal to the length of the filament or tow path through said stretching apparatus.

7. A combination as claimed in claim 1 wherein said longitudinal slot is opposite to and faces said roller or rollers.

8. A combination as claimed in claim 1 wherein said longitudinal slot faces laterally toward the working zone of the filament(s) looped around said roller or rollers.

9. A combination as claimed in claim 8 embodying said roller or rollers around which several filaments are completely or partly looped, wherein the longitudinal slot is offset from the plane of curvature of the tube towards the working zone of the filaments on the roller through an angle of 30° to 150°.

10. A combination as claimed in claim 1, wherein the longitudinal slot has a funnel-like widening at the inlet end of the tube, the edges of the longitudinal slot beginning on the generatrices which each face towards the outermost working zone of a filament on the roller.

11. A combination as claimed in claim 1, embodying a roller around which several filaments are completely or partly looped, and means for shifting the tube parallel to the axis of the roller.

12. A combination as claimed in claim 1, wherein the ends of the tube lie in the planes tangential to the roller coinciding with the filament path.

13. A combination as claimed in claim 1, and further embodying a series of rollers around which one or more filaments are looped alternately and successively clockwise and counterclockwise, wherein the tube extends over the entire length of the filament path between the rollers, is curved in the direction of filament travel around each particular roller and, between two rollers, has a lateral slot which is situated in the common tangential plane of the successive rollers coinciding with the filament path and which joins together the two opposite longitudinal slots in the tube.

14. A combination as claimed in claim 1 wherein said roller or rollers are rotatably supported at both ends thereof on substantially uninterrupted side walls of a processing chamber.

15. A combination as claimed in claim 1, and further comprising a looping-type stretching apparatus for tows, wherein the rollers are mounted at both ends in a substantially uninterrupted side wall of a chamber, and wherein the tubes are fixedly connected to the frame of the looping-type stretching arrangement in a plane extending perpendicularly of the rollers.

16. A combination as claimed in claim 15 wherein the chamber is substantially uninterrupted on all sides with only an inlet slot and an outlet slot for the tows before which the inlet and outlet ends of the tube system open and end, respectively.

17. A combination as claimed in claim 1, wherein a curtain of air is produced adjacent the longitudinal slot by the provision along the longitudinal slot of air nozzles whose orifices are directed in the peripheral direction and/or towards the center of the tube and are optionally inclined in the direction of travel of the filament in the tube.

18. A combination as claimed in claim 1, the feed end of the filament having a knot forming a plug for urging the filament to be moved through the tube by said fluid stream.

19. A combination as claimed in claim 1 wherein the end of the filament to be fed into said tube is attached to a plug member designed to be driven through said tube by the fluid stream, an arm member projecting laterally from said plug member through said slot, and means on said arm member for releasably attaching said end of said filament to said arm member, whereby said filament is drawn by said plug member outside said tube.

20. A combination as claimed in claim 1, and further embodying a series of rollers around which one or more filaments are looped alternately and successively clockwise and counter-clockwise, wherein the tube extends over the entire length of the filament path between the rollers, is curved in the direction of the filament travel around each particular roller, and consists of a series of tube sections, each of which having ends which are lying in the plane coinciding with the filament path and common tangential plane of the successive rollers.

* * * * *